US005709379A

United States Patent [19]

Lötsch et al.

[11] Patent Number: 5,709,379

[45] Date of Patent: Jan. 20, 1998

[54] SHEET-FANNING DEVICE

[75] Inventors: Kurt Lötsch, Wiesenbach; Paul Nicola; Kurt Sandmeier, both of Heidelberg; Günter Zobl, Nussloch; Günter Andl, Sandhausen; Klaus Herzog, St.-Leon-Rot; Wolfgang Kretz, Meckesheim; Ulli Zeck, Nussloch; Gabriele Vetter, Kronau, all of Germany

[73] Assignee: Heidelberger Druckmaschinen AG, Heidelberg, Germany

[21] Appl. No.: 610,522

[22] Filed: Mar. 4, 1996

[30] Foreign Application Priority Data

Mar. 3, 1995 [DE] Germany ..... 295 03 618 U

[51] Int. Cl.[6] ..... B65H 3/46

[52] U.S. Cl. ..... 271/105; 271/31; 271/97; 271/152

[58] Field of Search ..... 271/90, 97, 31, 271/105, 109, 152, 154, 155, 156

[56] References Cited

U.S. PATENT DOCUMENTS

| | | | |
|---|---|---|---|
| 1,762,661 | 6/1930 | Low | 271/31 |
| 3,716,226 | 2/1973 | Kristner | 271/31 |
| 4,699,369 | 10/1987 | Zirilli | 271/105 |
| 5,092,578 | 3/1992 | Bergmeier et al. | 271/97 |
| 5,110,110 | 5/1992 | Witz et al. | 271/97 |

FOREIGN PATENT DOCUMENTS

| | | | |
|---|---|---|---|
| 2906873 | 9/1980 | Germany | 271/97 |
| 93 19 902.3 | 3/1994 | Germany . | |

*Primary Examiner*—H. Grant Skaggs

*Attorney, Agent, or Firm*—Herbert L. Lerner; Laurence A. Greenber

[57] ABSTRACT

Auxiliary device for assisting in singling or separating sheets in an upper region of a sheet pile provided for single-sheet transport in a sheet transport direction within a sheet processing machine, a respective top sheet of the sheet pile being removable therefrom at a given time by at least one singling or separating device including at least one sheet trailing edge blasting or blowing device for feeding the sheet to the sheet processing machine, includes at least one feeler rod disposed at a location transverse to the sheet transport direction for measuring the height of the sheet pile, and respective fanning or loosening blowers disposed laterally of the sheet pile upstream of the feeler rod, as viewed in the sheet transport direction.

4 Claims, 2 Drawing Sheets

SHEET-FANNING DEVICE

BACKGROUND OF THE INVENTION

Field of the Invention

The invention relates to a device for assisting or supporting sheet singling or separation in an upper region of a sheet pile provided for single-sheet transport in a sheet-processing machine, a feeler disposed transversely to the sheet transport direction being provided for measuring the height of the pile.

It has become known heretofore from German Utility Model G 93 19 902.3 to provide blast air devices in single-sheet feeders for assisting in sheet separation, such blast air devices being directed in an upper region of a sheet pile towards a trailing edge of the sheets, in order to fan or loosen the sheets.

In single-sheet feeders which feed the sheets in upright format, problems may arise during sheet singling or separation which result from the fact that the respective upper sheet, in a front region facing towards the sheet processing machine, is insufficiently loosened from an underlying second sheet in the vicinity of a feeler provided for measuring the height of the sheet pile. The second sheet is thus pulled into the sheet processing machine by the first sheet.

SUMMARY OF THE INVENTION

It is accordingly an object of the invention to provide a sheet-fanning or loosening device for sheet piles in a feeder region of a sheet-processing machine which has an improved sheet-fanning or loosening effect over that of corresponding prior-art devices.

With the foregoing and other objects in view, there is provided, in accordance with the invention, an auxiliary device for assisting in singling or separating sheets in an upper region of a sheet pile provided for single-sheet transport in a sheet transport direction within a sheet processing machine, a respective top sheet of the sheet pile being removable therefrom at a given time by at least one singling or separating device including at least one sheet trailing edge blasting or blowing device for feeding the sheet to the sheet processing machine, comprising at least one feeler rod disposed at a location transverse to the sheet transport direction for measuring the height of the sheet pile, and respective fanning or loosening blowers disposed laterally of the sheet pile upstream of the feeler rod, as viewed in the sheet transport direction.

In accordance with another feature of the invention, the sheet pile has front stops, and sheet front or leading-edge blower devices are disposed at the front stops of the sheet pile.

In accordance with a further feature of the invention, the sheet pile has respective side stops, and the respective fanning or loosening blowers are disposed at the respective side stops.

In accordance with a concomitant feature of the invention, the fanning or loosening blowers include a blower device which is swivelable and adjustable in height.

Advantageously, feelers can be used which extend crosswise to the sheet transport direction across the format width of the sheet to be processed, and are swivelable downwardly onto the sheet without causing any problems of adhesion between the first and second sheets.

An arrangement of the lateral fanning or loosening blowers so that the are horizontally swivelable and adjustable in height enables the fanning or loosening blowers to be directed exactly and to supply separating air to critical adhesion locations.

An arrangement of lateral fanning or loosening blowers, in particular upstream, as viewed in the sheet transport direction, of the pile-height measurer which is embodied as a feeler rod, assures a supply of separating air to particularly critical locations.

Other features which are considered as characteristic for the invention are set forth in the appended claims.

Although the invention is illustrated and described herein as embodied in a sheet-fanning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

DESCRIPTION OF THE PREFERRED EMBODIMENTS

Figure 1:
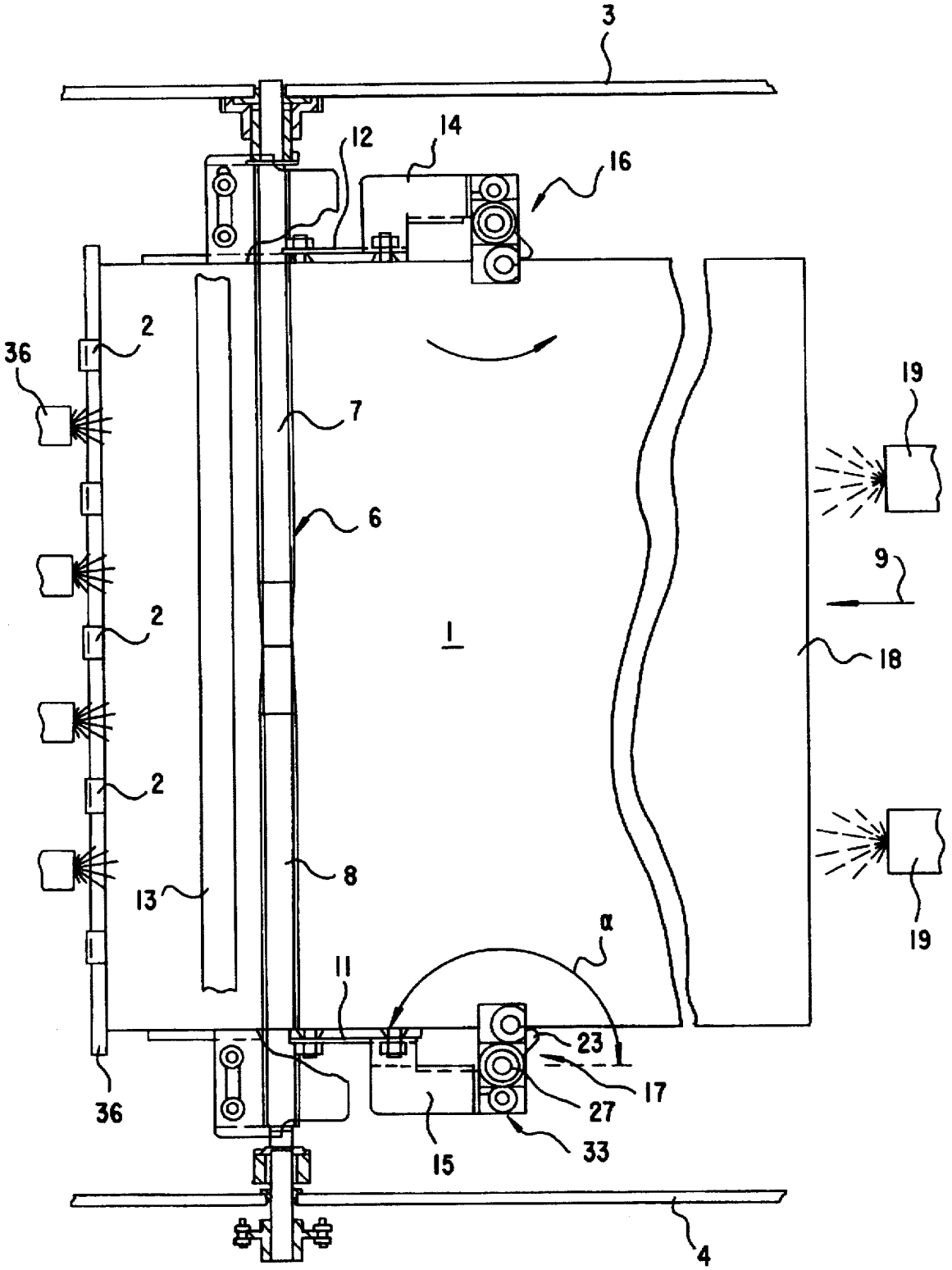
FIG. 1 is a diagrammatic top plan view of a sheet pile, with rear and lateral sheet-fanning or loosening blowers.

Referring now to the drawings and, first, particularly to FIG. 1 thereof, there is shown therein a pile 1 of sheets of paper in a feeder of a sheet processing machine, such as a printing press, having a leading-edge or front stop 2. A drivable spindle 6 is rotatably supported or journalled in side frames 3 and 4 above the sheet pile 2. The spindle 6 has a clockwise and a counterclockwise thread 7 and 8, respectively, and has displaceably supported side stops 11 and 12 disposed at locations crosswise to a sheet transport or feeding direction represented by the arrow 9. For pile height measurement, a feeler rod 13 is disposed parallel to the adjusting spindle 6, and is bringable by non-illustrated conventional means incrementally into contact with the respective top sheet of the pile 1.

A respective fanning or loosening blower 16, 17 is secured to each of the side stops 11 and 12 by means of a respective angle iron 14 and 15. The fanning blowers 16 and 17 are supplied by a non-illustrated central air source of the printing press via a common valve. Two fanning or loosening blowers 19 directed towards a trailing edge 18 of the sheet pile 1 separate the respective upper first sheet, particularly in a rear region of the pile 1, from an underlying second sheet.

The lateral fanning or loosening blowers 16 and 17 are identical in structure and, in the interest of easier comprehension, are described hereinafter in terms of only the one fanning or loosening blower 17.

Figure 2:
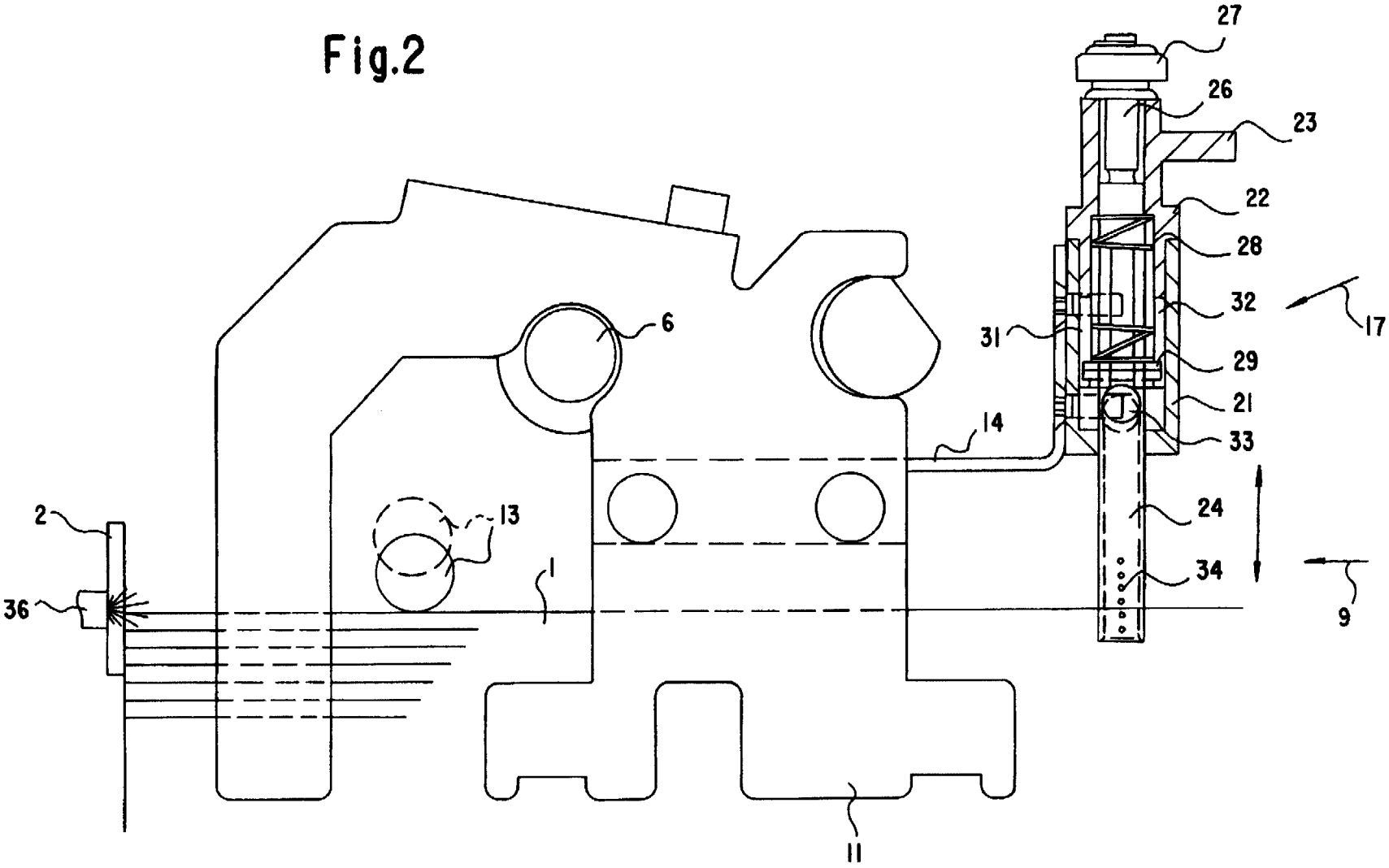
FIG. 2 is an enlarged fragmentary side elevational view of FIG. 1 showing in section, at an operating side of the sheet pile, a lateral fanning or loosening blower.

The fanning or loosening blower 17, has a vertically disposed bearing cylinder 21 secured to the angle iron 15. The bearing cylinder 21, on an inner wall thereof, carries a further swivelably supported adjusting cylinder 22 having a swivel range of 180°. A control handle 23 disposed at the peripheral surface of the adjusting cylinder 22 serves to adjust to a desired angle $\alpha$ and is simultaneously an indicator for the desired position of the respective fanning or loosening blower 16, 17. As shown in FIG. 2, a blast tube 24, which is adjustable in height, is disposed in the interior of the adjusting cylinder 22. The blast tube 24 is formed with an external thread 26 in an upper region thereof which threadedly engages with an adjusting or lock nut 27. The adjusting nut 27 is braced or supported on the adjusting cylinder 22. The blast tube 24 is surrounded coaxially by a compression spring 28, which is braced at one end thereof against a shoulder of the adjusting cylinder 22 and, at the other end thereof, against a pin 29. The pin 29 penetrates the blast tube 24 and projects outwardly with the ends thereof beyond the peripheral surface of the blast tube 24. Each of the ends of the blast tube 24 engage in respective guide slits 31 and 32 arranged vertically in the adjusting cylinder 22, thereby securing the blast tube 24 against rotation relative to the adjusting cylinder 22. An air inlet 33 into the blast tube 24 is provided below the pin 29. The blast tube 24 is sealed at the lower end thereof and is formed with blast openings 34, provided for a discharge of blast or blowing air, which are disposed in a row vertically below one another at the lower end of the blow pipe 24. The row is adjusted in height so that approximately two-thirds of the blast openings 34 above the sheet pile 1 are directed towards the sheet pile 1. By this measure, a sheet separated from the pile 1 by means of blast or blowing air can be maintained in floating condition on an air cushion at a short distance from the sheet pile 1.

To adjust the pivot lever angle $\alpha$ and, accordingly, the blowing or blast direction of the blast openings 34, the adjusting cylinder 22 is pivoted or swiveled by means of the control handle 23.

An adjustment in the height of the blast openings 34 is effected by means of the adjusting or check nut 27. By turning the check nut 27 clockwise, the blast tube 24 is adjusted upwardly, and by turning the check nut 27 counterclockwise the blast tube 24 is adjusted downwardly.

An adjustment of the loosening or fanning blowers 16 and 17 at the sheet pile 1 is performed together with the side plates 11 and 12 by means of the spindle 6.

A number of front or leading edge blowers 36 are provided between the front or leading edge stops 2 which are disposed along a line transverse to the sheet feeding direction represented by the line 9.

The blower devices, namely the front or leading edge blowers 36, the rear or trailing edge blowers 19, and the lateral fanning or loosening blowers 16 and 17, have the joint task of separating the topmost sheet of the sheet pile 1 at a given time from the sheet therebeneath. By means of the feeler rod 13 required for measuring the height of the pile 1, however, the supply of blast or blown air from the front or leading edge blowers to regions located in the vicinity and upstream of the feeler rod 13, as viewed in the sheet transport direction 9, are cyclically cut off.

Particularly when thin or lightweight paper is processed in upright format, the distance from the rear or trailing edge blowers 19 to the critical region is very great. Increasing the amount of blast or blown air is not possible, because the lightweight sheets would otherwise be blown away. Laterally disposing fanning or loosening blowers 16 and 17 directly upstream of the feeler rod 13, as viewed in the sheet transport direction, enables a finely metered adjustment of the fanning or loosening air to critical adhesion regions.

We claim:

1. Auxiliary device for assisting in singling or separating sheets in an upper region of a sheet pile provided for single-sheet transport in a sheet transport direction within a sheet processing machine, a respective top sheet of the sheet pile being removable therefrom at a given time by at least one singling or separating device including at least one sheet trailing edge blasting or blowing device for feeding the sheet to the sheet processing machine, comprising at least one feeler rod disposed transversely to the sheet transport direction for measuring the height of the sheet pile, and respective fanning or loosening blowers disposed laterally of the sheet pile upstream of said feeler rod, as viewed in the sheet transport direction.

2. Auxiliary device according to claim 1, wherein the sheet pile has front stops, and including sheet front or leading-edge blower devices disposed at the front stops of the sheet pile.

3. Auxiliary device according to claim 1, wherein the sheet pile has respective side stops, and wherein said respective fanning or loosening blowers are disposed at the respective side stops.

4. Auxiliary device according to claim 1, wherein said fanning or loosening blowers include a blower device which is swivelable and adjustable in height.

* * * * *